US010766726B2

(12) United States Patent
Kitayama

(10) Patent No.: US 10,766,726 B2
(45) Date of Patent: Sep. 8, 2020

(54) SHEET CONVEYING DEVICE FOR CONVEYING SHEETS SUCH AS DOCUMENTS, RECORDING PAPER, AND THE LIKE

(71) Applicant: KYOCERA Document Solutions Inc., Osaka (JP)

(72) Inventor: Kaori Kitayama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/232,550

(22) Filed: Dec. 26, 2018

(65) Prior Publication Data

US 2019/0225443 A1 Jul. 25, 2019

(30) Foreign Application Priority Data

Jan. 24, 2018 (JP) ..... 2018-009575

(51) Int. Cl.
*B65H 7/12* (2006.01)
*B65H 5/06* (2006.01)
*B65H 3/06* (2006.01)

(52) U.S. Cl.
CPC ..... *B65H 7/125* (2013.01); *B65H 3/06* (2013.01); *B65H 5/062* (2013.01); *B65H 2511/22* (2013.01); *B65H 2511/524* (2013.01); *B65H 2513/512* (2013.01); *B65H 2701/1311* (2013.01)

(58) Field of Classification Search
CPC . B65H 3/06; B65H 5/062; B65H 7/04; B65H 7/06; B65H 7/12; B65H 7/125; B65H 7/18; B65H 2511/22; B65H 2511/524; B65H 2513/512; B65H 2701/1311
See application file for complete search history.

(56) References Cited

U.S. PATENT DOCUMENTS

2016/0060056 A1* 3/2016 Yoshimura ..... B65H 7/06 271/3.18
2017/0315491 A1* 11/2017 Kawamura ..... B65H 3/06
2018/0194580 A1* 7/2018 Arima ..... B65H 7/125

FOREIGN PATENT DOCUMENTS

JP 2015-078039 A 4/2015

* cited by examiner

*Primary Examiner* — David H Bollinger
(74) *Attorney, Agent, or Firm* — Hawaii Patent Services; Nathaniel K. Fedde; Kenton N. Fedde

(57) ABSTRACT

Provided is a sheet conveying device capable of suppressing the recurrence of overlapped feeding in accordance with the detection of overlapped feeding. The sheet conveying device includes a paper-supply roller and a conveying roller. A sheet-detecting unit detects a leading edge position of a sheet. An overlapped-feeding-detecting unit detects overlapped-feeding of sheets. An overlapped-feeding-distance-calculating unit, based on detection results, calculates an overlapped-feeding distance in which sheets are overlapped. A conveyance-control unit causes the paper-supply roller to stop at a timing when a position separated a set length in a sheet-conveyance direction from a sheet trailing edge reaches the paper-supply roller. The conveyance-control unit, in a case where detection of overlapped feeding by the overlapped-feeding-detecting unit occurs a plurality of times, extends the set length based on the overlapped-feeding distance.

4 Claims, 7 Drawing Sheets

SHEET CONVEYING DEVICE FOR CONVEYING SHEETS SUCH AS DOCUMENTS, RECORDING PAPER, AND THE LIKE

INCORPORATION BY REFERENCE

This application is based on and claims the benefit of priority from Japanese Patent Application No. 2018-009575 filed on Jan. 24, 2018, the contents of which are hereby incorporated by reference.

BACKGROUND

The present disclosure relates to a sheet conveying device that conveys sheets such as documents, recording paper and the like.

Conventionally, an image forming apparatus such as a copying machine, printer and the like includes a sheet conveying device for feeding recording paper as a sheet, one by one to an image-forming unit. In such a sheet conveying devide, a technique for detecting overlapped feeding using a sensor such as an ultrasonic sensor for detecting overlapped feeding has been proposed.

SUMMARY

The sheet conveying device according to the present disclosure is a sheet conveying device that includes a paper-supply roller for feeding sheets one by one from a paper-supply unit to a paper-conveyance path, and a conveying-roller for conveying sheets fed to the paper-conveyance path by the paper-supply roller. The sheet conveying device further includes a sheet-detecting unit, an overlapped-feeding-detecting unit, an overlapped-feeding-distance-calculating unit, and a conveyance-control unit. The sheet-detecting unit detects a leading edge position of a sheet. The overlapped-feeding-detecting unit detects overlapped feeding of sheets. The overlapped-feeding-distance-calculating unit, based on the detection results of the sheet-detecting unit and the overlapped-feeding-detecting unit, calculates an overlapped-feeding distance in which sheets are overlapped. The conveyance-control unit causes the paper-supply roller to stop at a timing when a position separated a set length in the sheet-conveyance direction from a sheet trailing edge reaches the paper-supply roller. The conveyance-control unit, in a case where detection of overlapped feeding by the overlapped-feeding-detecting unit occurs a plurality of times, extends the set length based on the overlapped-feeding distance.

Moreover, the sheet conveying device according to the present disclosure is a sheet conveying device the includes a paper-supply roller for feeding sheets one by one from a paper-supply unit to a paper-conveyance path, and a conveying-roller for conveying sheets fed to the paper-conveyance path by the paper-supply roller. The sheet conveying device further includes a sheet-detecting unit, an overlapped-feeding-detecting unit, an overlapped-feeding-distance-calculating unit, and a conveyance-control unit. The sheet-detecting unit detects a leading edge position of a sheet. The overlapped-feeding-detecting unit detects overlapped-feeding of sheets. The overlapped-feeding-distance-calculating unit, based on the detection results of the sheet-detecting unit and the overlapped-feeding-detecting unit, calculates an overlapped-feeding distance in which sheets are overlapped. The conveyance-control unit causes the paper-supply roller to stop at a timing when a position separated a set length in the sheet-conveyance direction from a sheet trailing edge reaches the paper-supply roller. The conveyance-control unit, in a case where detection of overlapped-feeding by the overlapped-feeding-detecting unit occurs a plurality of times, changes the set length to the overlapped-feeding distance.

DETAILED DESCRIPTION

Figure 1:
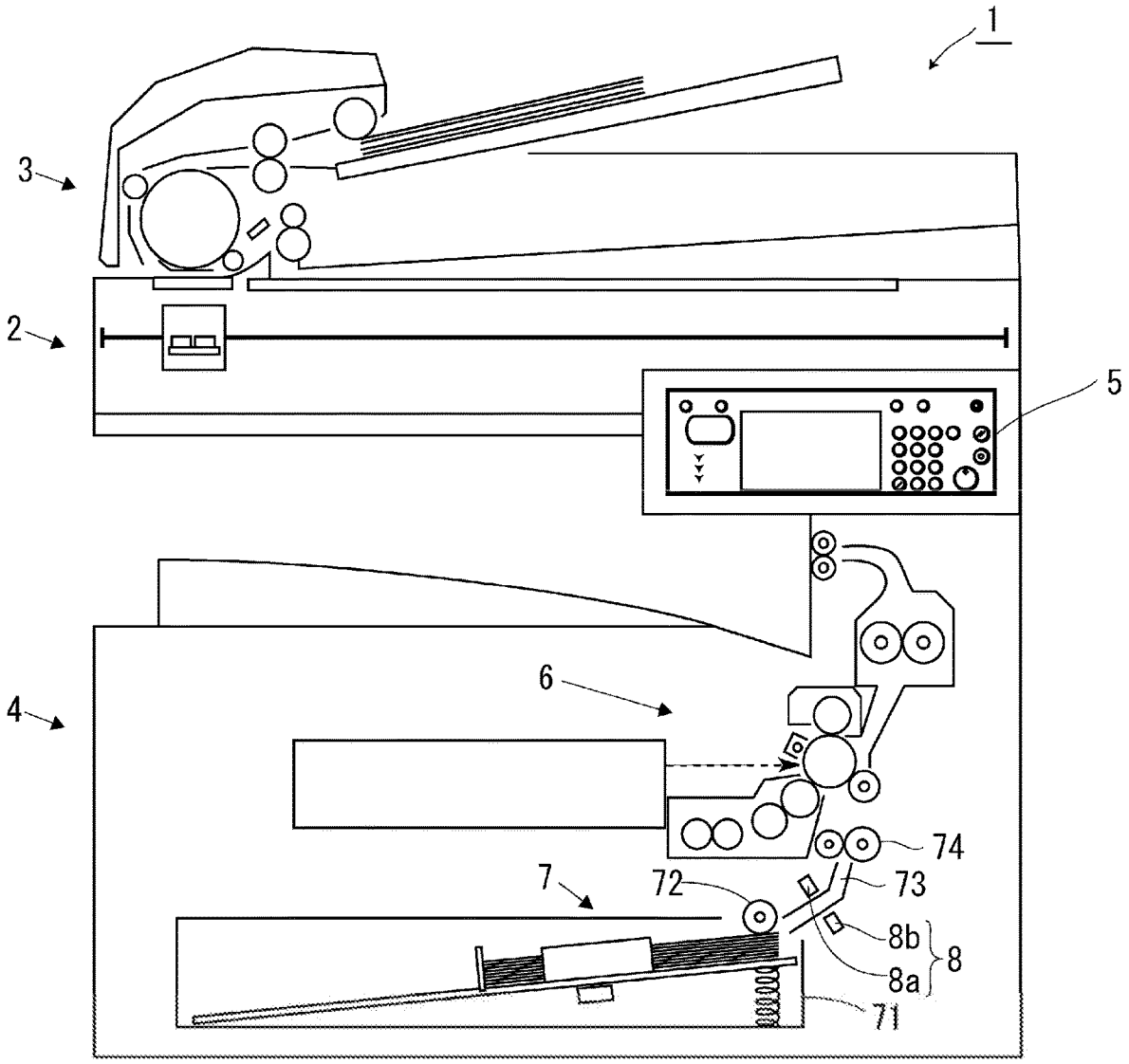
FIG. 1 is a schematic cross-sectional view of an embodiment of an image forming apparatus according to the present disclosure.

In the following, embodiments of the present disclosure will be described in detail with reference to the drawings. Note that in the following embodiments, the same reference numerals are given to the configurations showing similar functions.

As illustrated in FIG. 1, the image forming apparatus 1 of the present embodiment includes a document-reading unit 2, a document-feeding unit 3, a main unit 4, and an operation unit 5. The document-reading unit 2 is arranged on the upper portion of the main unit 4, and the operation unit 5 is arranged on the upper front side of the main unit 4.

The operation unit 5 is provided with a liquid-crystal display unit and various operation buttons. A user performs various settings such as an operating mode or the like by operating the operation unit 5 and inputting instructions. In doing so, a copying operation for recording a document image on recording paper, a network transmitting operation for transmitting a document image via a network such as the Internet or the like, and an accumulating operation for storing a document image in a database are executed.

The document-reading unit 2 is a scanner that reads a document image by irradiating light onto a document fed by the document-feeding unit 3 or a document placed on a platen glass, and receiving reflected light or the like from that document.

The document-feeding unit 3 sequentially feeds set documents one by one by a document-conveying mechanism and feeds them to a document reading position.

The main unit 4 includes an image-forming unit 6 and a sheet conveying device 7 that conveys recording paper as sheets.

The image-forming unit 6 includes, for example, a photosensitive drum, an optical unit, a developing unit, a transfer unit, and a fixing device. The optical unit forms an electrostatic latent image on the surface of the photosensitive drum based on a document image. The developing unit forms a toner image by causing toner to adhere to the surface of the photosensitive drum on which the electrostatic latent image is formed. The transfer unit transfers the toner image on the photosensitive drum to recording paper. The fixing device heats and fixes the toner image on the recording paper.

The sheet conveying device 7 includes a paper-supply unit 71, a paper-supply roller 72, a paper-conveyance path 73, and a conveying roller 74. The paper-supply unit 71 is a paper-supply cassette in which a plurality of sheets of recording paper is stored, and the paper-supply roller 72 feeds the recording paper one by one from the paper-supply unit 71 to the paper-conveyance path 73. The recording paper fed to the paper-conveyance path 73 by the paper-feeding roller 72 is conveyed to the image-forming unit 6 by the conveying roller 74. Then, the recording paper on which recording is performed by the image-forming unit 6 is discharged to a discharge space formed between the document-reading unit 2 and the main unit 4.

An ultrasonic sensor 8 is arranged on the downstream side in the sheet-conveyance direction of the paper-feeding roller 72, or in other words, is arranged in the paper-conveyance path 73 between the paper-feeding roller 72 and the conveying roller 74. The ultrasonic sensor 8 includes a transmitting unit 8*a* for transmitting ultrasonic waves and a receiving unit 8*b* for receiving ultrasonic waves from the transmitting unit 8*a*. The transmitting unit 8*a* and the receiving unit 8*b* are arranged on both sides in the vertical direction of the paper-conveyance path 73.

Figure 2:
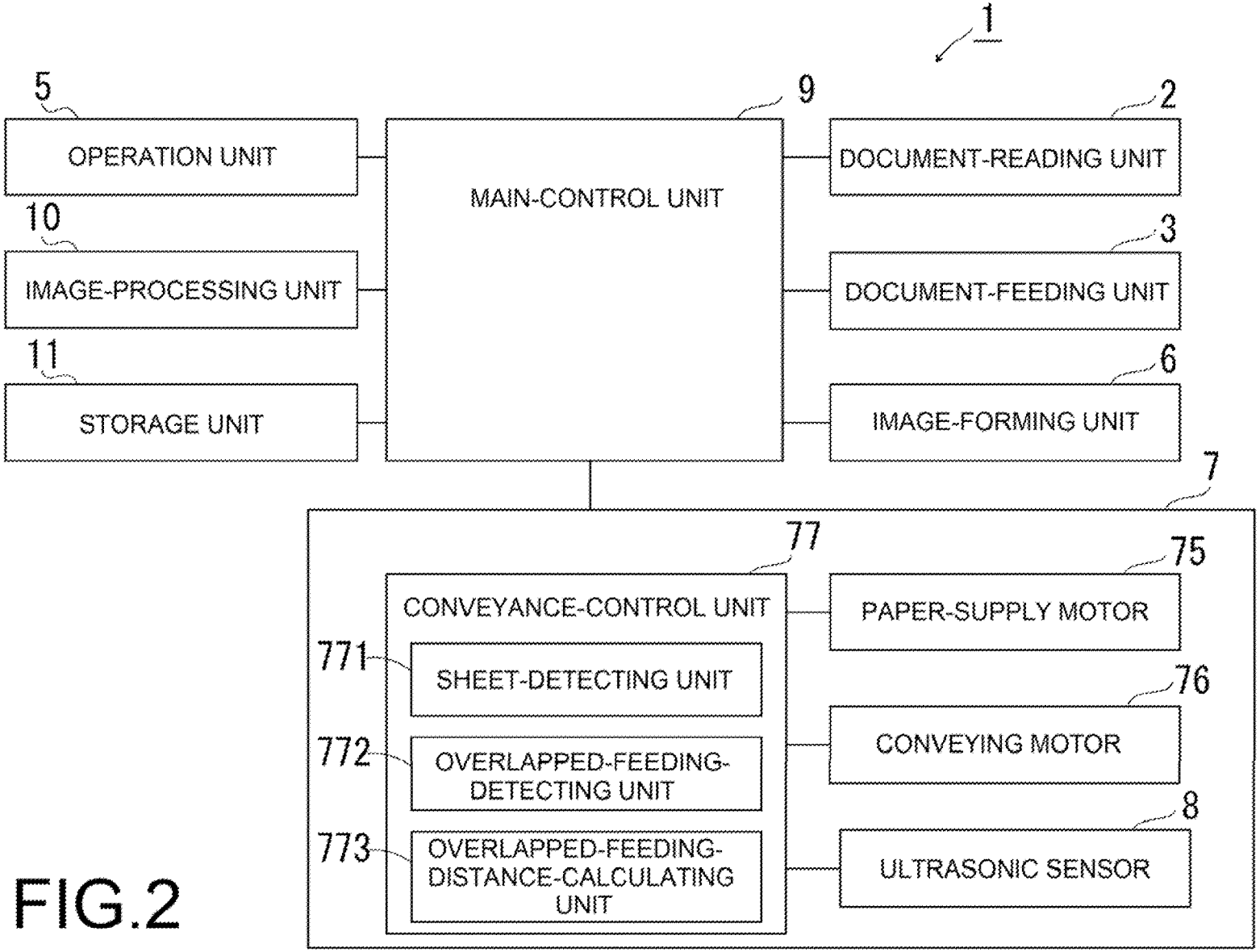
FIG. 2 is a block diagram illustrating a schematic configuration of the image forming apparatus illustrated in FIG. 1.

FIG. 2 is a block diagram illustrating a schematic configuration of the image forming apparatus 1. The above-described document-reading unit 2, document-feeding unit 3, operation unit 5, image-forming unit 6, and the sheet conveying device 7 are connected to a main-control unit 9, and the operation is controlled by the main-control unit 9. Moreover, an image-processing unit 10 and a storage unit 11 are connected to the main-control unit 9.

The main-control unit 9 is an information-processing unit such as a microcomputer or the like that includes a CPU (central processing unit), a ROM (read only memory), a RAM (random access memory), and the like. The ROM stores a control program for performing operation control of the image forming apparatus 1. The CPU of the main-control unit 9 performs overall control of the apparatus by reading the control program stored in the ROM and developing the control program in the RAM.

The image-processing unit 10 is a unit that performs specific image processing on image data; and, for example, performs image processing such as enlargement/reduction processing, gradation adjustment, density adjustment and the like.

The storage unit 11 is a storage unit such as a semiconductor memory, an HDD (hard disk drive), or the like, and together with storing image data acquired by reading a document by the document-reading unit 2, stores various kinds of management information.

The sheet conveying device 7 includes a paper-supply motor 75 for rotating the paper-supply roller 72, a conveying motor 76 for rotating the conveying roller 74, and a conveyance-control unit 77 for controlling the driving of the paper-supply motor 75 and the conveying motor 76.

The conveyance-control unit 77 is an arithmetic processing circuit such as a microcomputer or the like including a CPU (central processing unit), a ROM (read only memory), a RAM (random access memory), and the like. The ROM stores a control program for performing operation control of the sheet conveying device 7. The CPU of the conveyance-control unit 77, by reading the control program stored in the ROM and developing the control program in the RAM, controls the conveyance of sheets by driving the paper-supply motor 75 and the conveying motor 76 according to various instruction information from the main-control unit 9.

In addition, the ultrasonic sensor 8 is connected to the conveyance-control unit 77. Then, based on the output from the ultrasonic sensor 8, the conveyance-control unit 77 functions as a sheet-detecting unit 771 for detecting the leading edge of a sheet of recording paper, an overlapped-feeding-detecting unit 772 for detecting overlapped feeding, and a overlapped-feeding-distance-calculating unit 773 for calculating an overlapped-feeding distance.

Figure 3A:
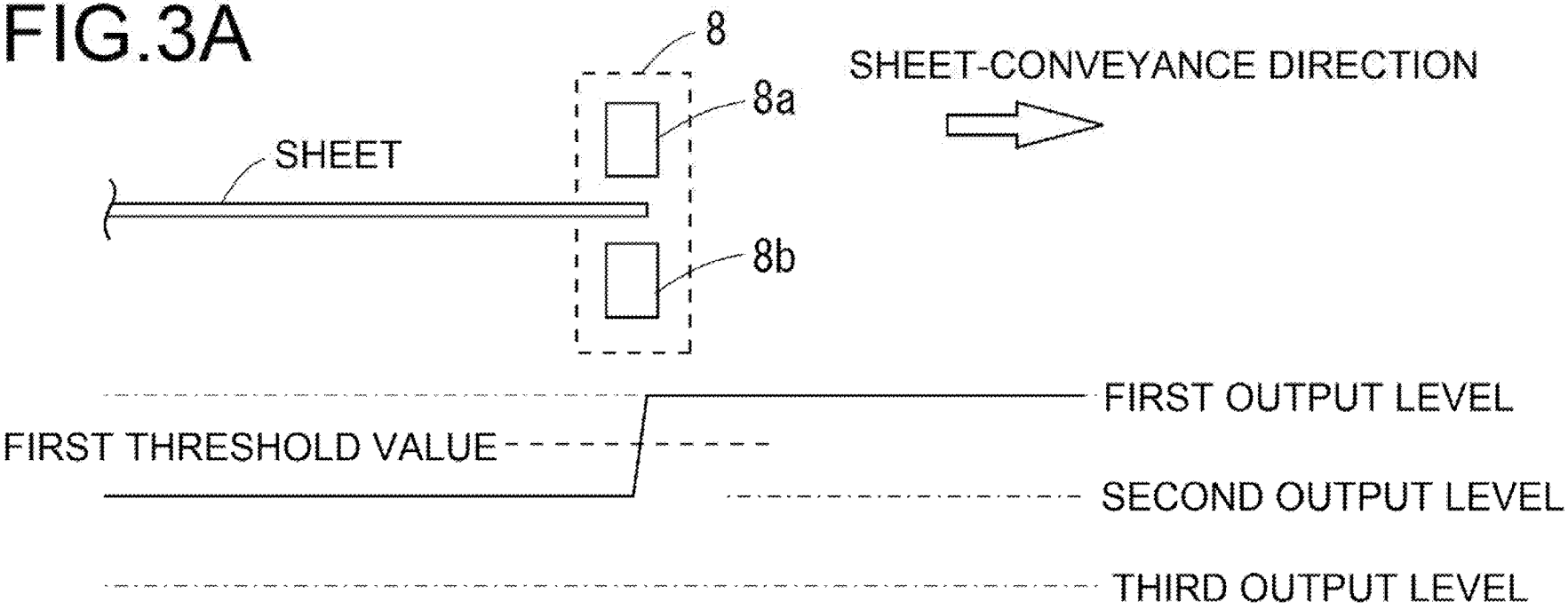
FIG. 3A is an explanatory diagram for explaining the sheet detection operation by the ultrasonic sensor in FIG. 1.

In the output from the ultrasonic sensor 8, when there is no sheet between the transmitting unit 8*a* and the receiving unit 8*b*, attenuation of the ultrasonic waves received by the receiving unit 8*b* is a minimum and is a specific first output level. Then, as illustrated in FIG. 3A, when a sheet is in a state of being properly conveyed and there is one sheet between the transmitting unit 8*a* and the receiving unit 8*b*, the attenuation of the ultrasonic waves received by the receiving section 8*b* becomes large, and the output level becomes a second output level that is less than the first output level when there is no sheet. Furthermore, as illustrated in FIG. 3B, when a state of overlapped feeding occurs and there is a plurality of sheets between the transmitting unit 8*a* and the receiving unit 8*b*, the attenuation of the ultrasonic waves received by the receiving unit 8*b* becomes even larger, and the output level becomes a third output level that is less than the second output level when there is one sheet.

Therefore, as illustrated in FIG. 3A, the sheet-detecting unit 771 compares the output from the ultrasonic sensor 8 with a first threshold value set to a value between the first output level and the second output level, and detects the arrival of the leading edge of a sheet at the timing when the output from the ultrasonic sensor 8 falls below the first threshold value.

Figure 3B:
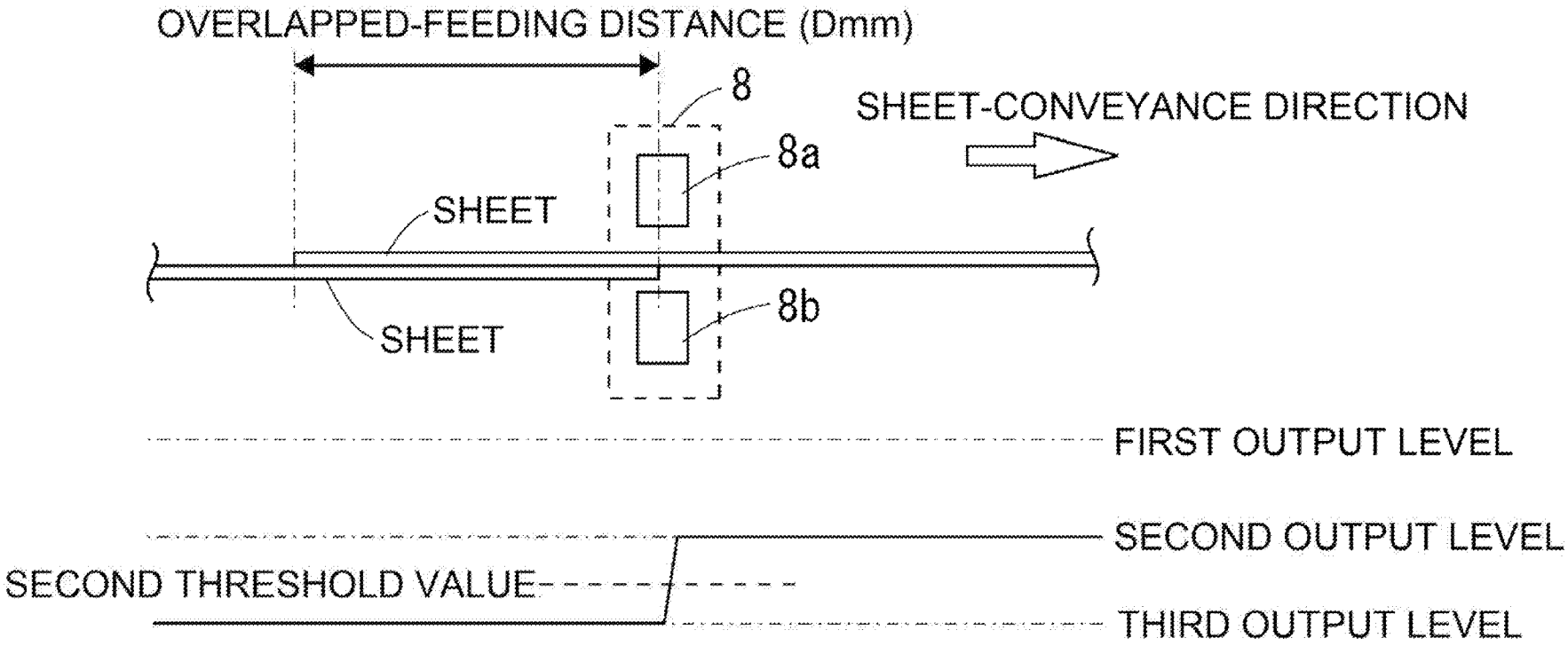
FIG. 3B is an explanatory diagram for explaining the sheet detection operation by the ultrasonic sensor in FIG. 1.

Moreover, as illustrated in FIG. 3B, the overlapped-feeding-detecting unit 772 compares the output from the ultrasonic sensor 8 with a second threshold set to a value between the second output level and the third output level, and when the output from the ultrasonic sensor 8 falls below the second threshold value, overlapped feeding of sheets is detected.

When overlapped feeding is detected by the overlapped-feeding-detecting unit 772, the overlapped-feeding-distance-calculating unit 773 measures the time from the detection of the leading edge of the sheet by the sheet-detecting unit 771 to the detection of the overlapped feeding by the overlapped-feeding-detecting unit 772. Then, the overlapped-feeding-distance-calculating unit 773 calculates a conveyance distance from the measured time and the conveyance speed (time×conveyance speed=conveyance distance) and calculates the overlapped-feeding distance (D mm) in which sheets overlap by subtracting the conveyance length from the paper length (overlapped-feeding distance=paper length−conveyance distance). Note that the paper length is the length in the sheet conveyance direction of the recording paper stored in the paper-supply unit 71, and is a value of a setting inputted from the operation unit 5, or a value grasped by a paper-detecting sensor or the like provided in the paper-supply unit 71.

Next, sheet conveyance control by the conveyance-control unit 77 will be described in detail with reference to FIGS. 4A to 4C.

When conveyance of recording paper is instructed from the main-control unit 9, the conveyance-control unit 77 causes the paper-supply roller 72 to rotate by driving the paper-supply motor 75, and feeds recording paper from the paper-supply unit 71 to the paper-conveyance path 73. At the same time as this, the conveyance-control unit 77 causes the conveying roller 74 to rotate by driving the conveying motor 76, and conveys the recording paper toward the image-forming unit 6. In order to unify paper behavior while conveying the recording paper, rotation control of the paper-supply roller 72 and the conveying roller 74 is determined according to the paper type, size, and the like that are prescribed in advance.

Figure 4A:
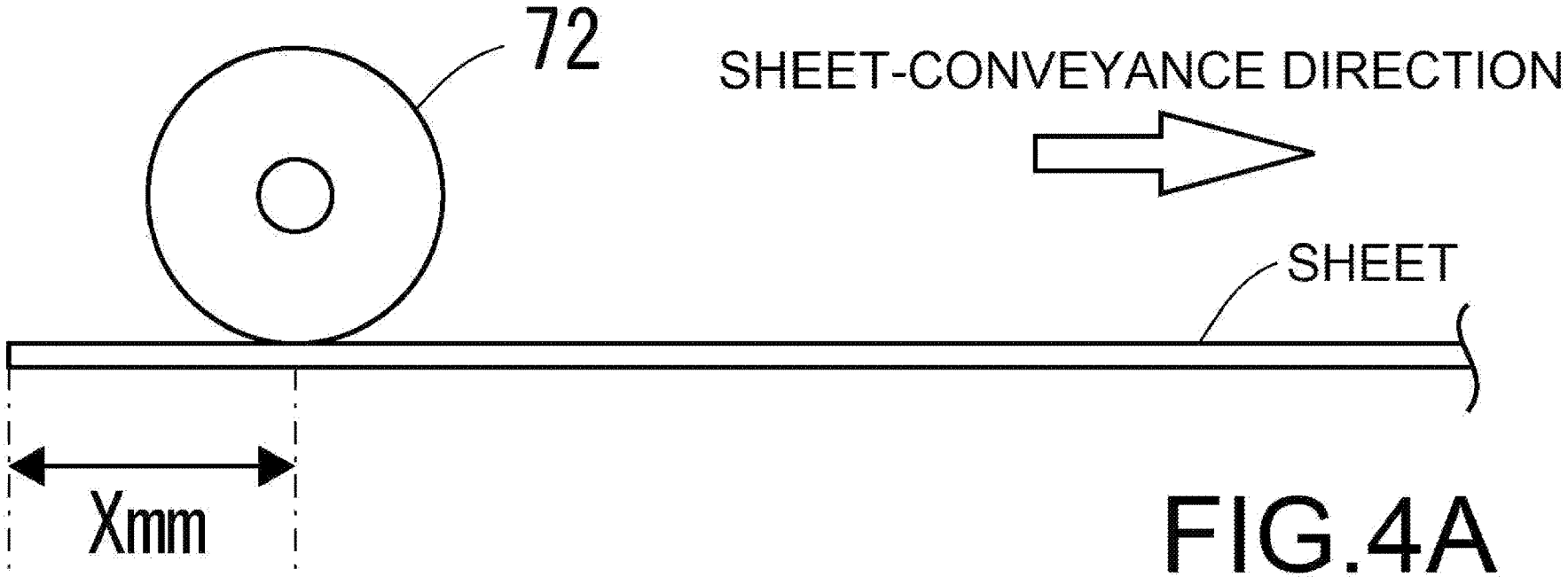
FIG. 4A is an explanatory view for explaining sheet conveyance control by the conveyance-control unit illustrated in FIG. 2.
Figure 4B:
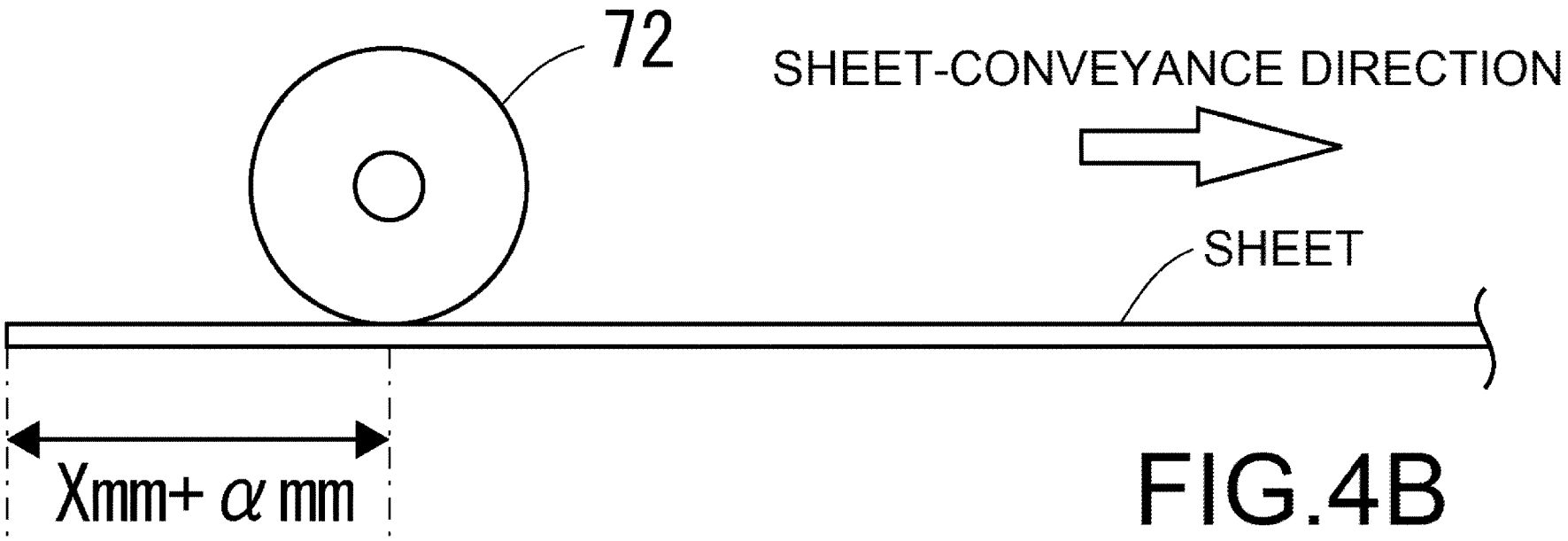
FIG. 4B is an explanatory view for explaining sheet conveyance control by the conveyance-control unit illustrated in FIG. 2.

Then, as illustrated in FIG. 4A, the conveyance-control unit 77, by causing the rotation of the paper-supply roller 72 to stop before the trailing edge of the recording paper passes, suppresses overlapped feeding of the recording paper by increasing the conveyance load in the vicinity of the trailing edge of the recording paper. The timing for stopping the paper-supply roller 72 is set with reference to the trailing edge of the recording paper, and the conveyance-control unit 77 causes the paper-supply roller 72 to stop at timing when a position separated by a set distance in the sheet-conveyance direction from the trailing edge of the recording paper reaches the paper-supply roller 72. Incidentally, it should be noted that the set length is set to the preset initial value=X mm in the case where the sheet is normally conveyed.

A description will be given of a case where detection of overlapped feeding by the overlapped-feeding-detecting unit 772 occurs a plurality of times under the same conveyance conditions (paper size, cassette paper-supply tray, paper type, and the like). In this case, as illustrated in FIG. 4B, the conveyance-control unit 77 suppresses overlapped feeding of the recording paper by further increasing the conveyance load in the vicinity of the trailing edge of the recording paper by changing the set length to a value (X mm+$\alpha$ mm) obtained by adding an adjustment value ($\alpha$ mm) to the initial value (X mm).

The conveyance-control unit 77 determines the adjustment value ($\alpha$ mm) based on the overlapped-feeding distance calculated by the overlapped-feeding-distance-calculating unit 773. The overlapped-feeding-distance-calculating unit 773 sets the adjustment value ($\alpha$ mm) to be longer as the overlapped-feeding distance becomes longer. The adjustment value ($\alpha$ mm) may be calculated by multiplying the overlapped-feeding distance by a coefficient, or it may be determined in stages according to the overlapped-feeding distance.

Figure 4C:
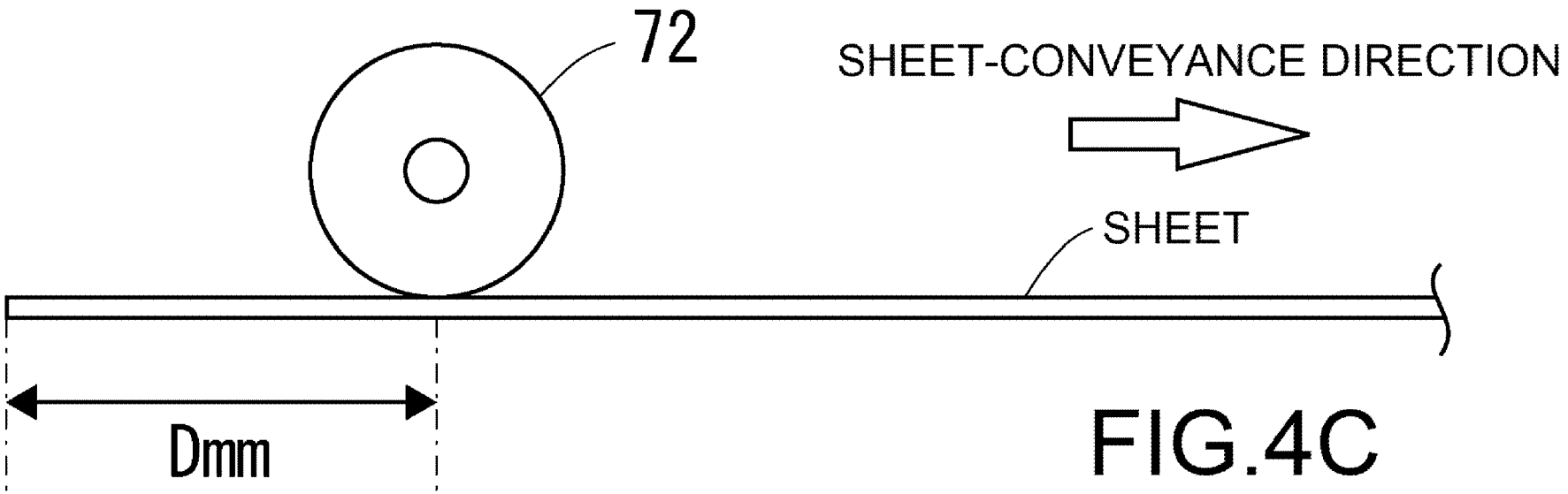
FIG. 4C is an explanatory view for explaining sheet conveyance control by the conveyance-control unit illustrated in FIG. 2.

In addition, in the case where the detection of overlapped feeding by the overlapped-feeding-detecting unit 772 occurs a plurality of times under the same conveyance conditions (paper size, cassette paper-supply tray, paper type, and the like), the conveyance-control unit 77, as illustrated in FIG. 4C, may change the set length to the overlapped-feeding distance (D mm).

Incidentally, in the present embodiment, configuration is such that the position of the leading edge of the sheet and overlapped feeding are detected by the output of the ultrasonic sensor 8, however, configuration is also possible in which the position of the leading edge of the sheet and the overlapped feeding are detected by the output of an optical sensor. In this case, a light-emitting unit and a light-receiving unit are arranged so as to be on both sides in the vertical direction of document conveying path 73, and the position of the leading edge of the sheet and overlapped feeding are detected by the change in the light amount when a light emitted from the light-emitting unit passes through the sheet.

As described above, according to this embodiment, a sheet conveying device 7 includes a paper-supply roller 72 for feeding sheets one by one from a paper-supply unit 71 to a paper-conveyance path 73, and a conveying-roller 74 for conveying sheets fed to the paper-conveyance path 73 by the paper-supply roller 72; and further includes: a sheet-detecting unit 771 for detecting the leading edge position of a sheet; an overlapped-feeding-detecting unit 772 for detecting overlapped feeding of sheets; an overlapped-feeding-distance-calculating unit 773 that, based on the detection results of the sheet-detecting unit and the overlapped-feeding-detecting unit, calculates an overlapped-feeding distance in which sheets are overlapped; and a conveyance-control unit 77 that causes the paper-supply roller 72 to stop at a timing when a position separated a set length in the sheet-conveyance direction from a sheet trailing edge reaches the paper-supply roller 72; wherein, the conveyance-control unit 77, in a case where detection of overlapped feeding by the overlapped-feeding-detecting unit 772 occurs a plurality of times, extends the set length based on the overlapped-feeding distance. More specifically, the conveyance-control unit 77 changes the set length to a value obtained by adding an adjustment value based on the overlapped-feeding distance to the initial value.

With this configuration, the conveyance load in the vicinity of the trailing edge of the recording paper can be further increased in accordance with the detection of overlapped feeding, so it is possible to suppress the recurrence of overlapped feeding, and thus it is possible to improve the down time of an apparatus due to the frequent occurrence of overlapped feeding.

Moreover, according to this embodiment, a sheet conveying device 7 includes a paper-supply roller 72 for feeding sheets one by one from a paper-supply unit 71 to a paper-conveyance path 73, and a conveying-roller 74 for conveying sheets fed to the paper-conveyance path 73 by the paper-supply roller 72; and further includes: a sheet-detecting unit 771 for detecting the leading edge position of a sheet; an overlapped-feeding-detecting unit 772 for detecting overlapped feeding of sheets; an overlapped-feeding-distance-calculating unit 773 that, based on the detection results of the sheet-detecting unit and the overlapped-feeding-detecting unit, calculates an overlapped-feeding distance in which sheets are overlapped; and a conveyance-control unit 77 that causes the paper-supply roller 72 to stop at a timing when a position separated a set length in the sheet-conveyance direction from a sheet trailing edge reaches the paper-supply roller 72; wherein, the conveyance-control unit 77, in a case where detection of overlapped feeding by the overlapped-feeding-detecting unit 772 occurs a plurality of times, changes the set length to the overlapped-feeding distance.

With this configuration, the conveyance load at a location where overlapped-feeding occurs is increased, so it is possible to suppress the recurrence of overlapped feeding, and thus it is possible to improve the down time of an apparatus due to the frequent occurrence of overlapped feeding.

According to a typical technique, upon detection of the occurrence of overlapped feeding, sheet conveyance is stopped as overlapped-feeding-occurrence error processing. However, overlapped feeding often recurs until the cause is eliminated, and there is a problem of a situation, "the apparatus cannot be used due to the constant occurrence of overlapped feeding," occurring until the paper-supply roller, or the like, is replaced, or until a service technician visits.

According to the present disclosure, it is possible to suppress the recurrence of overlapped feeding in accordance with detection of overlapped feeding, and it is possible to improve the down time of an apparatus in the case where overlapped feeding occurs frequently.

It should be noted that the technique according to the present disclosure is not limited to each of the above embodiments, and it is apparent that each embodiment can be appropriately changed within the scope of the technical idea of the present disclosure. Moreover, the number, the position, the shape, and the like of the above-described constituent members are not limited to those in the above embodiments, but may be a number, a position, a shape, and the like suitable for implementing the technique of the present disclosure. Note that in each figure, the same reference numerals are given to the same constituent elements.

What is claimed is:

1. A sheet conveying device comprising a paper-supply roller for feeding sheets one by one from a paper-supply unit to a paper-conveyance path, and a conveying-roller for conveying the sheets fed to the paper-conveyance path by the paper-supply roller; and further comprising:

a sheet-detecting unit for detecting a leading edge position of a sheet;

an overlapped-feeding-detecting unit for detecting overlapped feeding of the sheets;

an overlapped-feeding-distance-calculating unit that, based on the detection results of the sheet-detecting unit and the overlapped-feeding-detecting unit, calculates an overlapped-feeding distance in which the sheets are overlapped; and a conveyance-control unit that causes the paper-supply roller to stop at a timing when a part of the sheet reaches the paper-supply roller; wherein, the paper-supply roller feeds the sheets in a sheet-conveyance direction from the paper-supply unit to the paper-conveyance path;

the part of the sheet is defined as a position on the sheet that is separated a set length, in the sheet-conveyance direction, from a trailing edge of the sheet; and the conveyance-control unit, in a case where detection of overlapped feeding by the overlapped-feeding-detecting unit occurs a plurality of times, extends the set length based on the overlapped-feeding distance.

2. The sheet conveying device according to claim 1 wherein the conveyance-control unit:

obtains an initial value;

determines an adjustment value based on the overlapped-feeding distance, wherein there is a positive correlation between the adjustment value and the overlapped-feeding distance; and determines the set length by adding the adjustment value to the initial value.

3. The sheet conveying device according to claim 2 wherein the conveyance-control unit:

determines the adjustment value by multiplying the overlapped-feeding distance by a coefficient; or determines the adjustment value based on the overlapped-feeding distance in stages such that the adjustment value is larger as the overlapped-feeding distance becomes larger.

4. A sheet conveying device comprising a paper-supply roller for feeding sheets one by one from a paper-supply unit to a paper-conveyance path, and a conveying-roller for conveying the sheets fed to the paper-conveyance path by the paper-supply roller; and further comprising:

a sheet-detecting unit for detecting a leading edge position of a sheet;

an overlapped-feeding-detecting unit for detecting overlapped feeding of the sheets;

an overlapped-feeding-distance-calculating unit that, based on the detection results of the sheet-detecting unit and the overlapped-feeding-detecting unit, calculates an overlapped-feeding distance in which the sheets are overlapped; and a conveyance-control unit that causes the paper-supply roller to stop at a timing when a part of the sheet reaches the paper-supply roller; wherein, the paper-supply roller feeds the sheets in a sheet-conveyance direction from the paper-supply unit to the paper-conveyance path;

the part of the sheet is defined as a position on the sheet that is separated a set length, in the sheet-conveyance direction, from a trailing edge of the sheet; and the conveyance-control unit, in a case where detection of overlapped feeding by the overlapped-feeding-detecting unit occurs a plurality of times, changes the set length to the overlapped-feeding distance.

* * * * *